US006928690B2

(12) United States Patent
Ji

(10) Patent No.: US 6,928,690 B2
(45) Date of Patent: Aug. 16, 2005

(54) VACUUM CLEANER WHICH SECURES TO A SURFACE

(75) Inventor: Heon Pycong Ji, Pusankwangyok-shi (KR)

(73) Assignee: LG Electronics Inc., Seoul (KR)

( * ) Notice: Subject to any disclaimer, the term of this patent is extended or adjusted under 35 U.S.C. 154(b) by 340 days.

(21) Appl. No.: 10/222,834

(22) Filed: Aug. 19, 2002

(65) Prior Publication Data

US 2003/0121120 A1 Jul. 3, 2003

(30) Foreign Application Priority Data

Dec. 28, 2001 (KR) ..... 2001-87128

(51) Int. Cl.[7] ..... A47L 9/32

(52) U.S. Cl. ..... 15/339; 15/327.7; 15/352; 15/410

(58) Field of Search ..... 15/339, 327.5, 15/327.2, 327.7, 327.1, 352, 353, 410

(56) References Cited

U.S. PATENT DOCUMENTS

| | | | | | |
|---|---|---|---|---|---|
| 3,015,123 | A | * | 1/1962 | Descarries | 15/327.2 |
| 3,881,535 | A | * | 5/1975 | Du Bois et al. | 15/327.2 |
| 5,214,822 | A | * | 6/1993 | Sakurai et al. | 15/327.2 |
| 5,720,076 | A | * | 2/1998 | Clark | 15/339 |
| 5,755,007 | A | * | 5/1998 | Dyson | 15/327.5 |
| 6,484,350 | B2 | * | 11/2002 | Yung | 15/327.1 |
| 2001/0049928 | A1 | | 12/2001 | Park et al. | |
| 2003/0101536 | A1 | * | 6/2003 | Hefter et al. | 15/339 |

FOREIGN PATENT DOCUMENTS

| | | |
|---|---|---|
| DE | 198 42 246 A1 | 3/2000 |
| GB | 2 297 243 A | 7/1996 |
| WO | WO-96/22726 A1 | 8/1996 |

* cited by examiner

*Primary Examiner*—Theresa T. Snider
(74) *Attorney, Agent, or Firm*—McKenna Long & Aldridge LLP

(57) ABSTRACT

A vacuum cleaner is disclosed, which includes a main body formed of a fan motor generating a driving force therein, a fan, and a cyclone dust collector, a suction head connected to the main body and sucking in all kinds of impurity existing on a surface that is to be cleaned, a suction hose connected to the front portion of the main body and an extension tube connected to the suction head both installed between the main body and the suction head, a dust collecting chamber detachably fixed on a rear side of the main body and having a handle on an outer rear surface thereof, a lower holding part of the handle on the dust collecting chamber projecting beyond the lower circumference of the wheels and coming into contact with the surface of a lower step, when the front portion of the main body of the vacuum cleaner is fastened to the edge of an upper step, and a roller caster formed on both sides of the lower front portion of the main body allowing back-and-forth motions and rotations on a flat surface and fastening the vacuum cleaner to the edge of the upper steps, thereby preventing the main body of the vacuum cleaner from slipping down the stairway.

13 Claims, 7 Drawing Sheets

VACUUM CLEANER WHICH SECURES TO A SURFACE

This application claims the benefit of the Korean Application No. P2001-87128 filed on Dec. 28, 2001, which is hereby incorporated by reference.

BACKGROUND OF THE INVENTION

1. Field of the Invention

The present invention relates to vacuum cleaner, and more particularly, to a vacuum cleaner enabling a user to clean steps of a stairway without manually lifting the main body while cleaning the stairway.

2. Discussion of the Related Art

Generally, a vacuum cleaner is an electric appliance that cleans indoor areas, such as the inside of a house or car. By generating a vacuum suction force, the vacuum cleaner removes unwanted impurities such as dust existing therein.

As shown in FIG. 1, a vacuum cleaner basically includes a main body 1, which is formed of a fan motor generating a driving force therein, a fan, and a cyclone dust collector (not shown), and a suction head 2 connected to the main body 1 and sucking in all kinds of impurity existing on a surface to be cleaned.

A suction hose 3 connected to a front portion of the main body 1, and an extension tube 4 connected to the suction head 2, are both installed between the main body 1 and the suction head 2. Herein, the suction hose 3 and the extension tube 4 are connected to one another.

Meanwhile, an exhaust filter 5 filtering and discharging air, which is sucked in through the suction head 2 along with the dust, is fixed on one side of the front portion of the main body 1. Wheels 6 are fixed on both sides of the rear portion of the main body 1, enabling the main body 1 to make back-and-forth rolling motions. A roller caster 7 is fixed on the front lower surface of the main body 1, so as to allow back-and-forth rolling and rotating motions on a flat surface, thereby enabling the user to control and move the main body 1 to a desired direction.

A dust collecting chamber 8 is detachably fixed onto the main body 1 between the wheels 6. Meanwhile, the upper side of the main body 1 is equipped with a handle 100 for handling the main body 1.

When operated, the vacuum cleaner having the above-described structure sucks in air along with the impurities therein through the suction head 2. The impurities are separated from the air by using a cyclonic principle of separation, which are then sent to the dust collecting chamber 8 to be collected. The air separated from the impurities is discharged to the outside through the exhaust filter 5.

However, when cleaning stairways, the related art vacuum cleaner has a tendency to slip down the stairs due to the load of the main body 1.

Because of the structural feature of a handle 80 attached to the dust collecting chamber 8, as shown in FIG. 2, the handle 80 does not come into contact with the surface of the step, unlike the wheels 6 on the rear portion of the main body 1. This results in an-easy slippage of the main body 1 of the related art vacuum cleaner.

Therefore, a separate wedge is necessary for preventing such slippage. Accordingly, the user undergoes the inconvenience of lifting the main body 1 with one hand and holding the extension tube 4 or the handle 400 of the extension tube 4 with the other hand, while going up and down the stairway in order to clean the steps.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner with an improved structure allowing the main body to remain fixed to the stairs without slipping, while cleaning the steps.

Another object of the present invention is to provide a vacuum cleaner that does not require the user to manually lift the main body while cleaning the steps.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a main body formed of a fan motor generating a driving force therein, a fan, and a cyclone dust collector, a suction head connected to the main body and sucking in all kinds of impurity existing on a surface that is to be cleaned, a suction hose connected to the front portion of the main body and an extension tube connected to the suction head both installed between the main body and the suction head, a dust collecting chamber detachably fixed on a rear side of the main body and having a handle on an outer rear surface thereof, a lower holding part of the handle on the dust collecting chamber projecting beyond the wheels and coming into contact with the surface of a lower step, when the front portion of the main body of the vacuum cleaner is fastened to the edge of an upper step, and a roller caster formed on both sides of the lower front portion of the main body allowing back-and-forth motions and rotations on a flat surface formed on both sides of the lower front portion of the main body and fastening the vacuum cleaner to the edge of the upper steps, thereby preventing the main body of the vacuum cleaner from slipping down the stairway.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
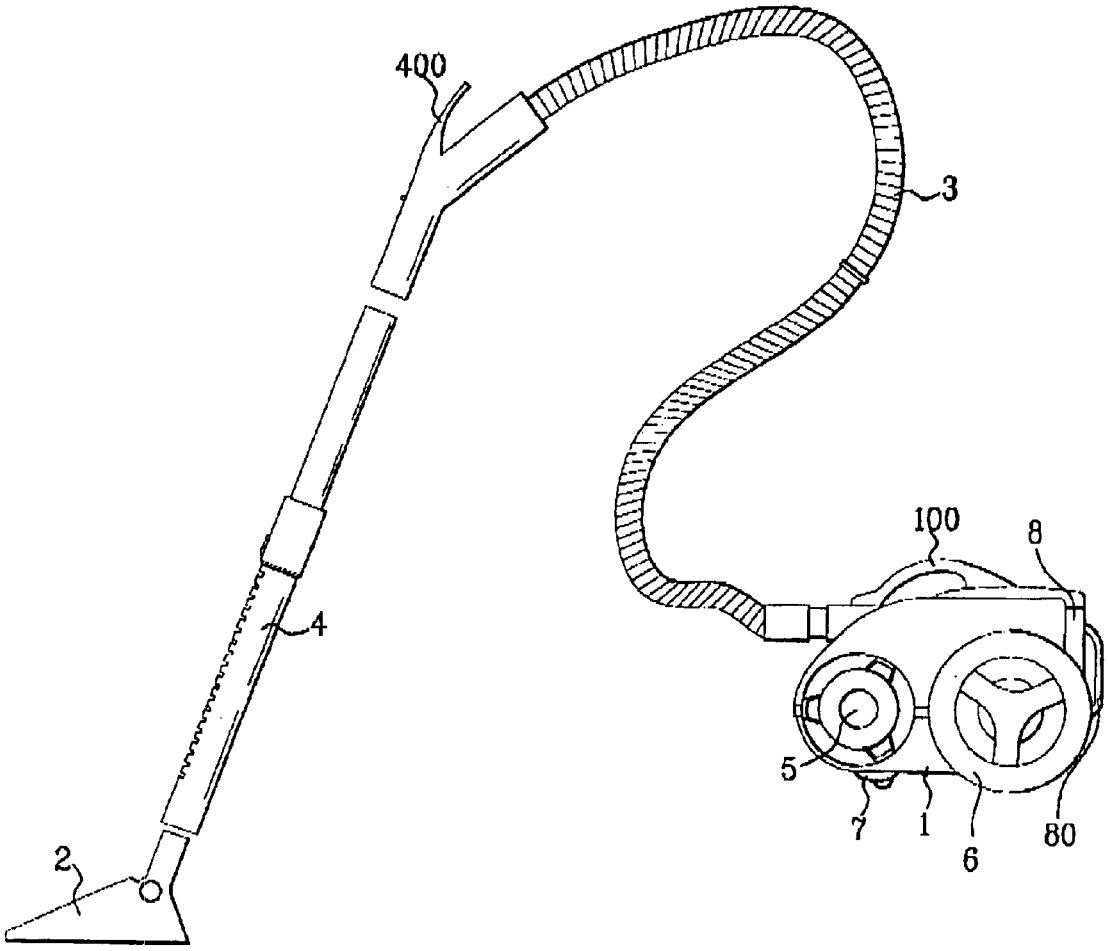
FIG.1 Related Art
FIG. 1 is a side elevation view illustrating a related art vacuum cleaner.
Figure 2:
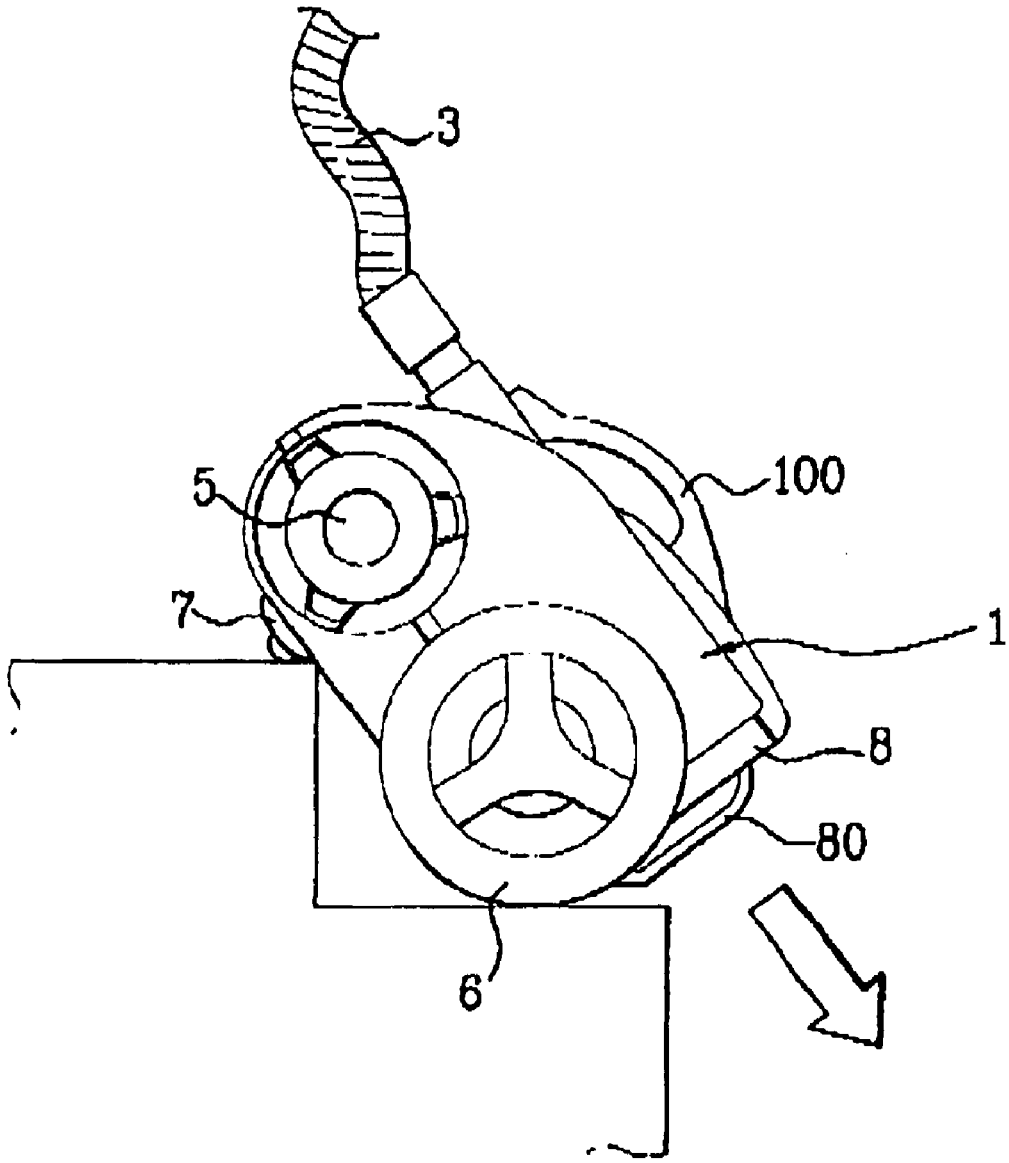
FIG.2 Related Art
FIG. 2 is a side elevation view illustrating a state whereby a main body of the vacuum cleaner in FIG. 1 is fastened to an edge of a step on a stairway.
Figure 3:
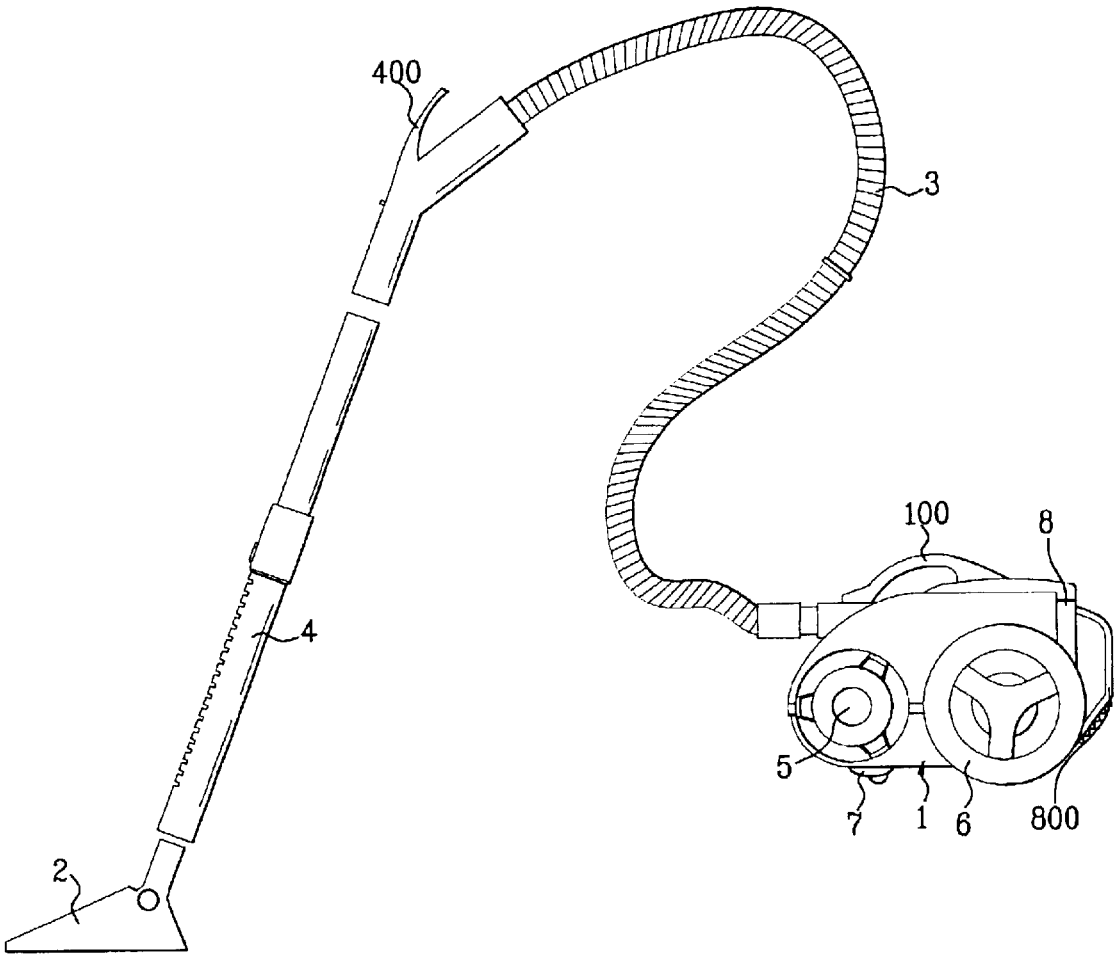
FIG. 3 is a side elevation view illustrating a vacuum cleaner according to the present invention.
Figure 4A:
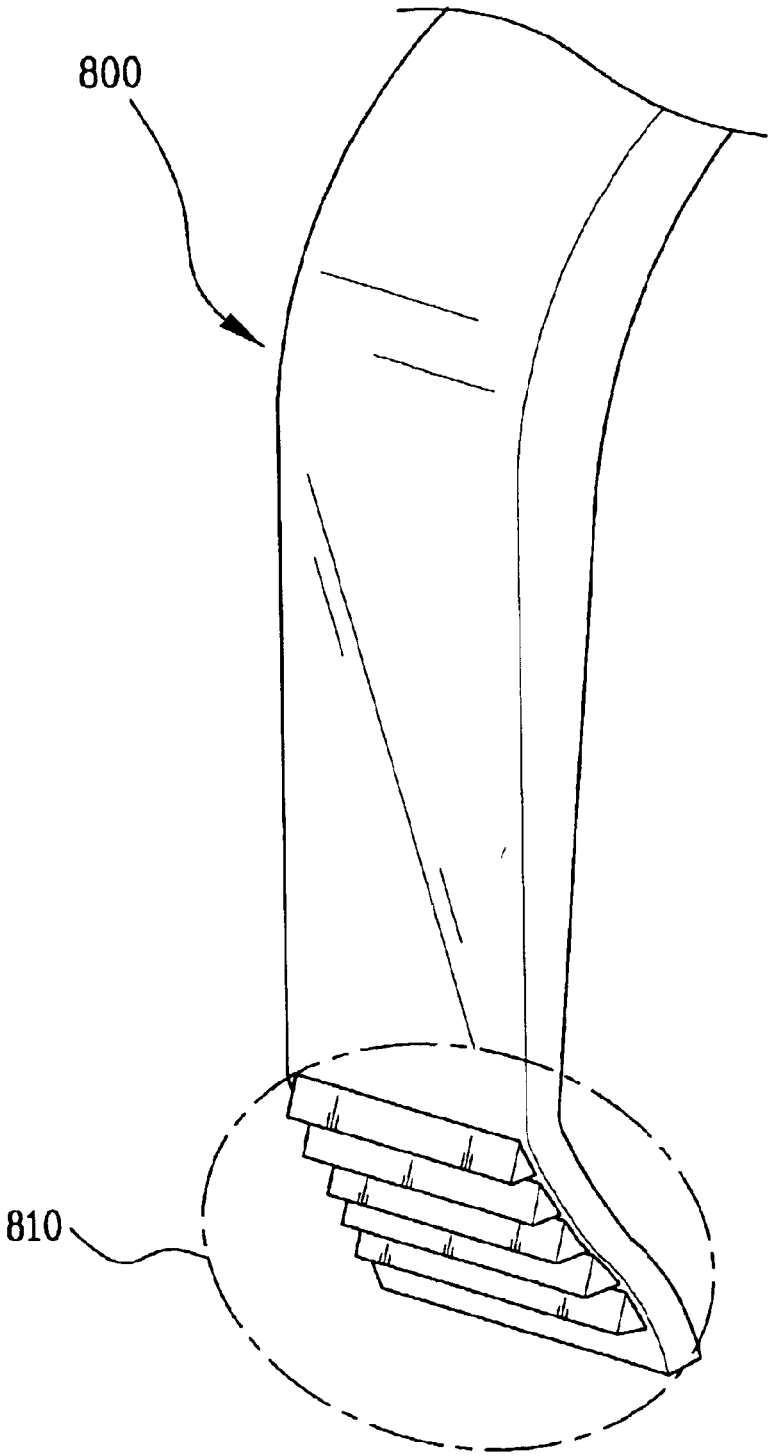
FIG. 4A is a perspective view illustrating portion 'A' in FIG. 3.
Figure 4B:
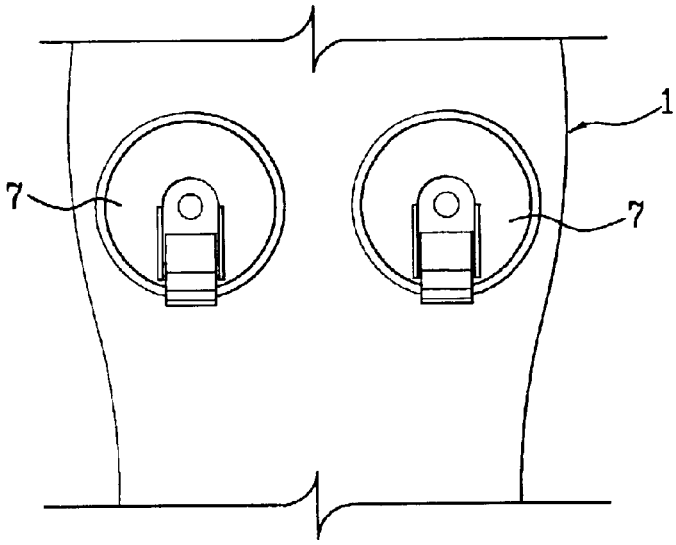
FIG. 4B is a plane view illustrating a principal part within a bottom surface of the main body of the vacuum cleaner of FIG. 3.
Figure 5:
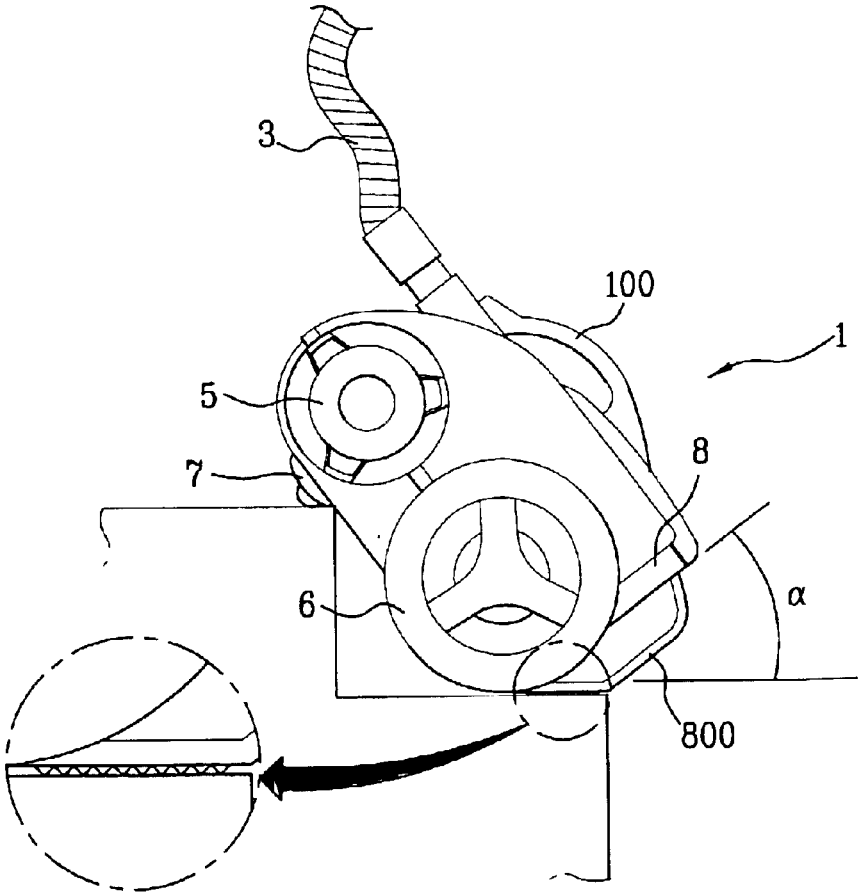
FIG. 5 is a side elevation view illustrating a state wherein the main body of the vacuum cleaner in FIG. 3 is fastened to an edge of a step on the stairway.

FIG. 3 is a side elevation view illustrating a vacuum cleaner according to the present invention. FIG. 4A is a perspective view illustrating portion 'A' of FIG. 3. FIG. 4B is a plane view illustrating a principal part within a bottom surface of the main body of the vacuum cleaner in FIG. 3. And, FIG. 5 is a side elevation view illustrating a state wherein a main body of the vacuum cleaner, shown in FIG. 3, is secured to an edge of a step on the stairway. The vacuum cleaner includes a main body 1 formed of a fan motor generating a driving force therein, a fan, and a cyclone dust collector, a suction head 2 connected to the main body 1 and sucking in all kinds of impurity existing on a surface that is to be cleaned, a suction hose 3 connected to the front portion of the main body and an extension tube 4 connected to the suction head 2 both installed between the main body 1 and the suction head 2, a dust collecting chamber 8 detachably fixed on a rear side of the main body 1 and having a handle 800 on an outer rear surface thereof, a lower holding part of the handle 800 on the dust collecting chamber 8 projecting beyond the lower circumference of the wheels and coming into contact with the surface of a lower step, when the front portion of the main body 1 of the vacuum cleaner is fastened to the edge of an upper step, and a roller caster 7 formed on both sides of the lower front portion of the main body 1 allowing back-and-forth motions and rotations on a flat surface and fastening the vacuum cleaner to the edge of the upper steps, thereby preventing the main body 1 of the vacuum cleaner from slipping down the stairway.

Herein, the lower holding part of the handle 800 on the dust collecting chamber 8, which is located near the wheels 6 and comes into contact with the surface of a step along with the wheels, is equipped with ridges 810 to prevent the vacuum cleaner from slipping.

In order to increase friction, the side of the ridges 810 can be shaped into triangular forms and other forms. The ridges may also take the geometric form of a plurality of ribs.

Additionally, the angle formed between the lower holding part of the handle 800 on the dust collecting chamber 8 and the external surface of the dust collecting chamber 8 should be set at a range of about 30° to 60°. Herein, the optimum angle is 45°.

Meanwhile, the width of the lower holding part of the handle 800 becomes larger as the holding part nears the lower portion, which is connected to the dust collecting chamber 8.

The operation of the present invention having the above structure will now be described.

In the vacuum cleaner according to the present invention, the handle 800 on the dust collecting chamber 8 prevents the main body 1 of the vacuum cleaner from slipping down the steps, when cleaning a stairway.

More specifically, when a roller caster 7 fixed on both sides of the lower front portion of the main body 1 of the vacuum cleaner is fastened to the edge of an upper step, as shown in FIG. 5, the lower holding part of the handle 800 fixed onto the dust collecting chamber 8 projects beyond the wheels 6. Thus, friction caused thereof prevents the main body 1 of the vacuum cleaner from slipping down the stairs.

Unlike the related art vacuum cleaner, whereby only a single roller caster is installed on the lower front portion of a main body, the roller casters 7 are installed on both left and right sides of the lower portion of the main body 1 in the present invention. The bearing power from the edge of a step is reinforced, thereby well balancing the left and right sides of the front portion of the main body 1. This prevents the main body 1 from being tilted to one side, thereby enabling the main body 1 to be stably fastened on the surface of the step.

Additionally, ridges 810 are formed on the lower portion of the handle 800 on the dust collecting chamber 8, which increase the friction between the lower portion of the handle 800 and the surface of the step, thereby efficiently preventing the main body from slipping down the steps.

Therefore, the present invention facilitates the process of cleaning stairways without having to pin a separate wedge under the wheels 6 or to manually lift the main body 1 while cleaning.

Figure 6:
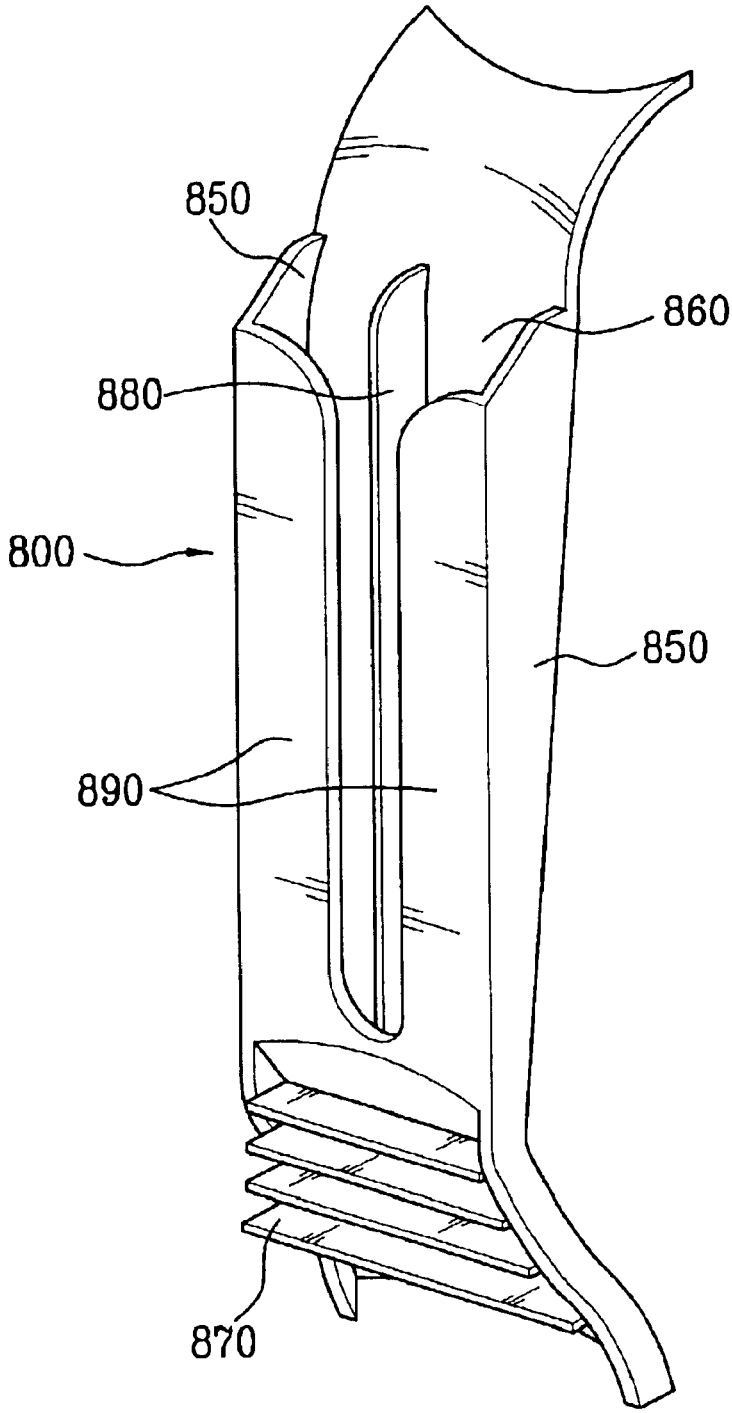
FIG. 6 is a perspective view illustrating a principal part of a handle according to another embodiment of the present invention.

FIG. 6 is a perspective view illustrating a principal part of a handle according to another embodiment of the present invention. The handle 800 on the dust collecting chamber 8 is formed of left and right side walls 850 both spaced apart to a set distance in a longitudinal direction and a rear wall 860 connecting the inner ends of the left and right side walls 850, so that a cross-section of the handle 800 forms a "u" shape when cut in a direction perpendicular to the longitudinal direction. On the lower holding part of the handle 800, a plurality of ribs are formed to project beyond the left and right side walls 850 of the handle 800, in order to strengthen the handle 800 and to provide friction, which prevents the main body 1 from slipping down the stairway.

Herein, the ribs 870 on the lower bent portion of the handle 800 should be parallel to a flat surface, when the main body 1 of the vacuum cleaner is placed thereon.

On the inner center of the rear wall on the handle 800 held by the user, a reinforcing rib 880 is formed along the horizontal direction of the handle. Additionally, a holding part 890 is formed from each end of the left and right side walls 850 and the inside of the handle 800.

In this embodiment, the lower holding part of the handle 800, whereby the plurality of ribs 870 causing friction are formed, should be set more apart as the holding part nears the lower portion of the handle, which is connected to the dust collecting chamber 8.

The function of the handle preventing the main body 1 of the vacuum cleaner from slipping down the steps is the same as described above. More specifically, when cleaning staircases by using the present invention, the roller casters 7 installed on both the left and right lower front sides of the main body 1 are fastened to the edge of the upper steps. The plurality of ribs formed on the lower portion of the handle 800 on the dust collecting chamber 8 come into contact with the surface of the step, thereby preventing slippage of the main body 1.

In the present embodiment, as shown in FIG. 5, the roller casters 7 of the main body 1 are fastened to the edge of the upper step and the lower holding portion of the handle 800 on the dust collecting chamber 8 comes into contact with the surface of the lower step along with the wheels 6. Then, the ribs 870 formed on the lower bent portion of the handle 800, which is parallel to the slope of the staircase, form an angle of about 45° with the flat surface of the lower step whereby the wheels 6 are fastened. The ribs 870 function as a wedge, thereby preventing the main body 1 of the vacuum cleaner from slipping down the staircase.

In addition to the above advantage, the handle 800 of the dust collecting chamber according to the present embodiment can be formed by using less materials. Also, the ribs 870 allow the handle 800 to be stronger than a handle without any ribs.

When fabricating the handle 800, a plurality of cavities for forming the ribs 870 may also be formed in a vertical direction, so as to allow a mold for forming the ribs to be easily removed from the cavities.

As described above, instead of a ruffle 810 formed as part of the handle 800 on the dust collecting chamber 8, the handle 800 may also be equipped with a member formed of a separate piece, which produces friction upon contact with a flat surface (i.e., a friction pad) when the front lower portion of the main body 1 of a vacuum cleaner is fastened to the edge of an upper step while cleaning the staircase.

Figure 7:
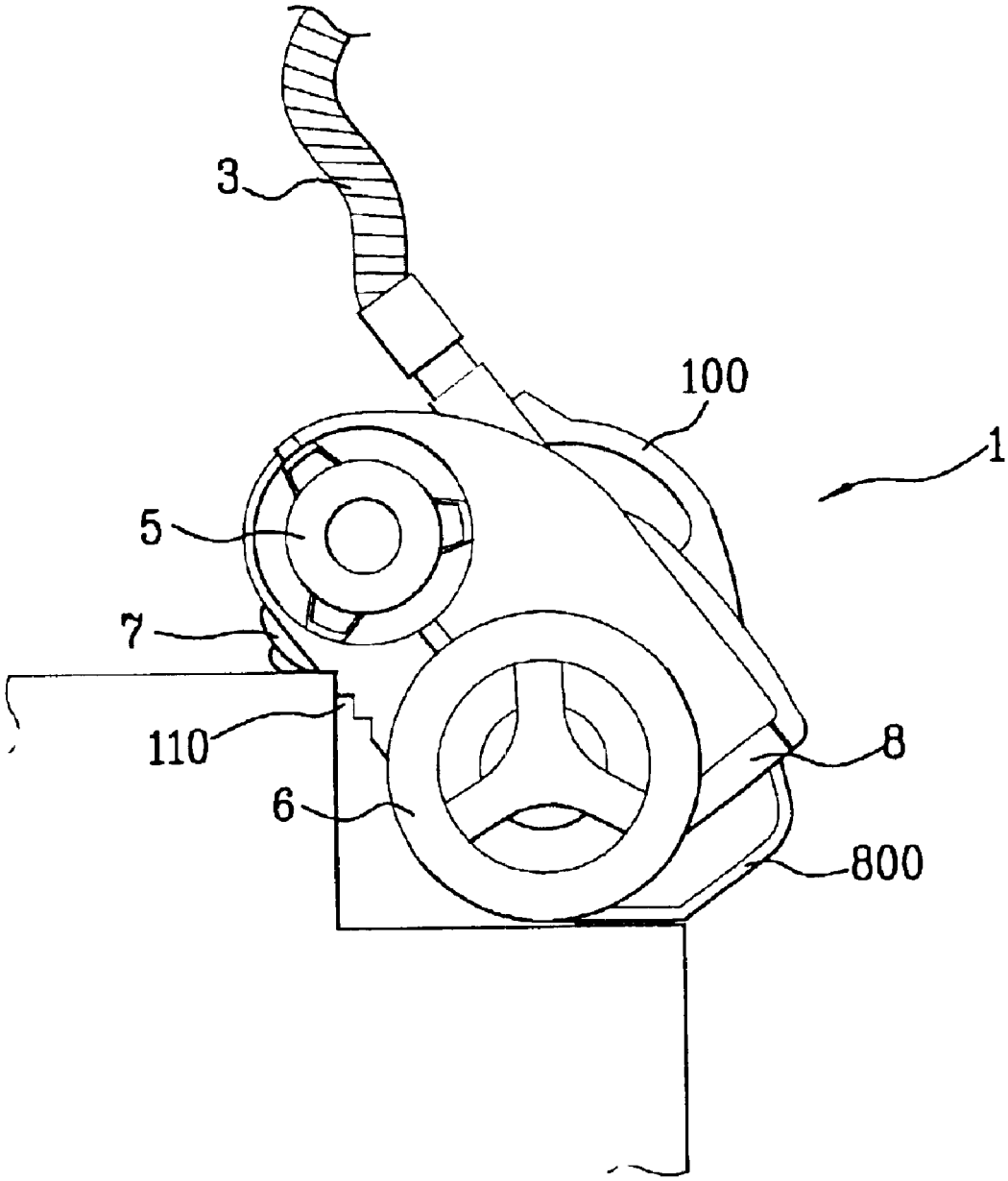
FIG. 7 is a perspective view illustrating the vacuum cleaner according to another embodiment of the present invention.

FIG. 7 is a perspective view illustrating the vacuum cleaner according to another embodiment of the present invention. As shown in FIG. 7, a ruffle 110 made of a plurality of irregular shapes is formed in the region behind each roller casters 7 on the lower front portion of the main body 1. By making a plurality of grooves of the irregular shapes fit the outline of a step, the level of friction caused to prevent the main body 1 of the vacuum cleaner from slipping may be increased.

As described above, the structure of the vacuum cleaner of the present invention has been improved in order to prevent the main body 1 of the vacuum cleaner from slipping down the steps when cleaning a stairway.

Accordingly, when using the present invention, the user is able to clean the staircase without having to lift the main body 1 up, thereby providing a more convenient method of cleaning. Further, reliability of the vacuum cleaner can also be improved.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A vacuum cleaner comprising:

a main body having a fan motor generating a driving force therein, a fan, and a cyclone dust collector;

a suction head connected to the main body for sucking in all kinds of impurities existing on a surface that is to be cleaned;

a suction hose connected to a front portion of the main body and an extension tube connected to the suction head such that both are disposed between the main body and the suction head;

a dust collecting chamber detachably fixed on a rear side of the main body and having a handle on an outer rear surface thereof;

a lower holding part of the handle on the dust collecting chamber projecting past wheels affixed to the main body where the lower holding part contacts a surface of a lower step when the front portion of the main body of the vacuum cleaner secures to an upper step; and a roller caster disposed on both sides of a lower front portion of the main body allowing back-and-forth rolling motions and rotations on a flat surface and securing the vacuum cleaner to the edge of the upper steps, thereby preventing the main body of the vacuum cleaner from slipping down a stairway.

2. The vacuum cleaner according to claim 1, wherein the lower holding part of a handle formed on the dust collecting chamber includes a ridge preventing the main body from slipping.

3. The vacuum cleaner according to claim 2, wherein a profile of the ridge is shaped as a repetition of triangles.

4. The vacuum cleaner according to claim 2, wherein an angle formed between the lower holding part of the handle, where the ridge is formed, and an outer surface of the dust collecting chamber is set at a range of about 30° to 60°.

5. The vacuum cleaner according to claim 4, wherein the angle formed between the lower holding part of the handle, where the ridge is formed, and the outer surface of the dust collecting chamber is set at 45°.

6. The vacuum cleaner according to claim 1, wherein the handle formed on the dust collecting chamber includes, left and right side walls both spaced apart to a set distance in a longitudinal direction;

a rear wall connecting each inner end of the left and right side walls, so that a cross-section of the handle forms a 'u' shape when cut in a direction perpendicular to the longitudinal direction; and a plurality of ribs, disposed in the lower holding part, projecting beyond the left and right side walls of the handle in order to strengthen the handle and to provide friction, which prevents the main body from slipping down the stairway.

7. The vacuum cleaner according to claim 6, wherein the ribs are shaped to be parallel to a flat surface upon which the main body is placed thereon.

8. The vacuum cleaner according to claim 6, wherein the handle includes a plurality of cavities for forming the ribs formed in a vertical direction, so as to allow a mold for forming the ribs to be easily removed from the cavities.

9. The vacuum cleaner according to claim 6, wherein a reinforcing rib is formed along a horizontal direction of the handle in an inner center of the rear wall on the handle, which is held by a user.

10. The vacuum cleaner according to claim 6, wherein the handle further includes a second holding part formed from each end of the left and right side walls and the inside of the handle.

11. The vacuum cleaner according to claim 1, wherein a gap in a lower portion of the lower holding part on the handle becomes further apart as the gap nears the dust collecting chamber.

12. The vacuum cleaner according to claim 1, wherein the handle on the dust collecting chamber is equipped with a separate member mounted thereon, which comes into con tact with a surface of the lower step, when the front portion of the main body of the vacuum cleaner secures to the edge of a step.

13. The vacuum cleaner according to claim 1, wherein a plurality of irregular shapes is formed in a region behind each roller caster on the lower front portion of the main body, so as to allow a plurality of grooves of the irregular shapes fit an outline of the upper step, thereby increasing friction and preventing slipping of the main body of the vacuum cleaner.

* * * * *